US005538133A

United States Patent [19]

Campbell et al.

[11] Patent Number: 5,538,133

[45] Date of Patent: Jul. 23, 1996

[54] HOLDING ARRANGEMENT FOR CANS

[75] Inventors: Geoffrey Campbell, Kingswood; Keith Brimble, Yatton; Mark A. Fisher, Caldicot, all of United Kingdom

[73] Assignee: Riverwood International Corporation, Atlanta, Ga.

[21] Appl. No.: 256,694

[22] PCT Filed: Jan. 22, 1993

[86] PCT No.: PCT/GB93/00141

§ 371 Date: Nov. 7, 1994

§ 102(e) Date: Nov. 7, 1994

[87] PCT Pub. No.: WO93/14992

PCT Pub. Date: Aug. 5, 1993

[30] Foreign Application Priority Data

Jan. 25, 1992 [GB] United Kingdom ..... 9201647
Sep. 10, 1992 [GB] United Kingdom ..... 9219209

[51] Int. Cl.[6] ..... B65D 71/12

[52] U.S. Cl. ..... 206/427; 206/153; 206/161

[58] Field of Search ..... 206/139, 140, 206/145–161, 194, 197, 199, 427, 433

[56] References Cited

U.S. PATENT DOCUMENTS

| | | | |
|---|---|---|---|
| 3,118,537 | 1/1964 | Copping . | |
| 3,653,503 | 4/1972 | Arneson . | |
| 3,711,143 | 1/1973 | Smed | 206/158 |
| 3,734,278 | 5/1973 | Kerrigan et al. . | |
| 4,216,859 | 8/1980 | Bader et al. | 206/159 |
| 4,471,870 | 9/1984 | Uhlig | 206/150 |
| 5,103,971 | 4/1992 | Schuster | 206/153 |

FOREIGN PATENT DOCUMENTS

| | | | |
|---|---|---|---|
| 771502 | 11/1967 | Canada | 206/158 |
| 66029 | 12/1982 | European Pat. Off. | 206/427 |
| 0077442 | 4/1983 | European Pat. Off. . | |
| 2158037 | 11/1985 | United Kingdom . | |
| 2220186 | 1/1990 | United Kingdom . | |
| 9222470 | 12/1992 | WIPO . | |

*Primary Examiner*—Jimmy G. Foster
*Attorney, Agent, or Firm*—Hopkins & Thomas

[57] ABSTRACT

There is provided a package (10) for a plurality of cans (11). The package incorporates an inner blank (13) which incorporates pairs of arcuate cuts which are pressed over and engage below the can rims. An outer blank (14) is adhered to the inner blank (13) and hinged side panels (25, 27) are wrapped around the cans and the other side panels (26, 28) are adhered to them.

7 Claims, 4 Drawing Sheets

HOLDING ARRANGEMENT FOR CANS

Figure 1:
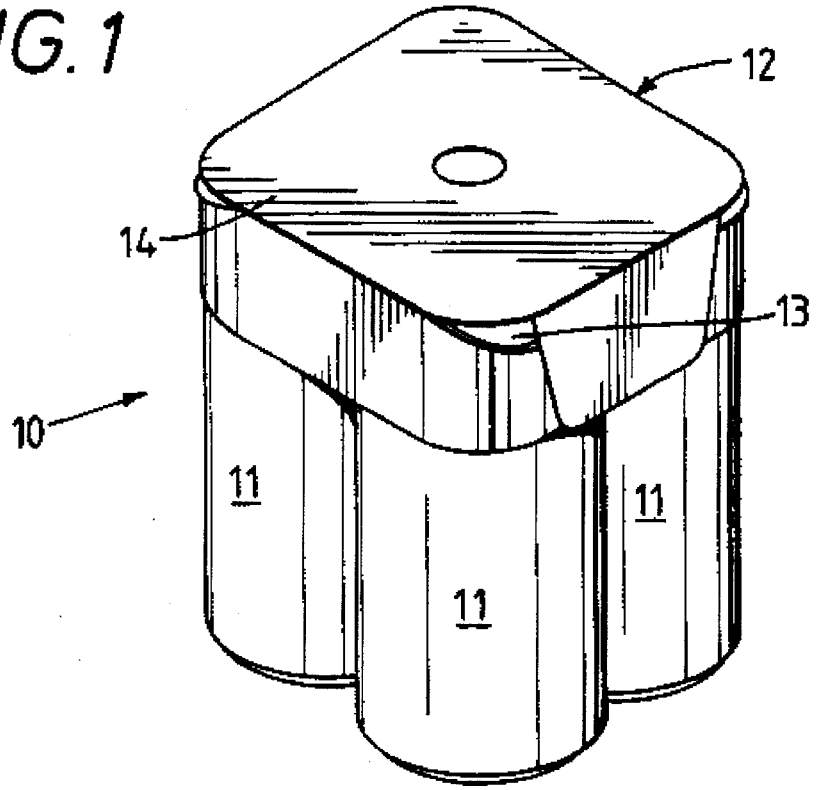

This invention relates to arrangements for holding a plurality of cans.

Multipacks of cans are well known for drinks and foodstuffs. Cans of drink are often sold in multipacks utilising a plastic ring having a number of apertures for receiving a corresponding number of cans. This number is often four or six. It is however desirable to cease using plastic in such multipacks.

Attempts have been made to produce satisfastory paperboard alternatives to the plastic ring but the alternatives tend to be of an all encompassing nature or sleeve-like.

According to a first aspect of the present invention there is provided a package for a plurality of cans, said package comprising first means which for each can has a top section and integral means for gripping each can below the top rim, said gripping means being arranged in an array such that each can is in substantially touching relation with all immediately adjacent cans, and second means having a top panel for attachment to said first means and side panel means for extending all around the periphery of the plurality of cans, said side panel means comprising one or more side panels hinged downwardly relative to said top panel, one or more of said side panels in contact with the cans and having one or more portions extending around one or more of said cans for attachment to at least one of said side panels.

Preferably said first and second means are made from paperboard. The first means is ideally made from a single piece of paperboard which constitutes all said top sections and gripping means. Conveniently each gripping means comprises a pair of spaced arcuate cuts between which the top of a can is disposed, the paperboard adjacent the cuts being pressed down under the rim of the can so as to grip the can below the rim.

In preferred arrangements the array may be generally rectangular, for example a 2×2, 2×3 or 2×4 array of cans, by virtue of the gripping means being arranged in a suitable array.

The top panel is preferably generally rectangular in plan view and four side panels are provided. In one arrangement an opposite pair of side panels, each has a pair of oppositely extending extensions which are, in use, bent around the adjacent corner can of the rectangular array such that each side panel of the other pair of opposite side panels is attached to two extensions, one from each of the first pair of side walls.

Ideally the top panel of the second means incorporates one or more formation to facilitate the picking up of the package. This formation may comprise one or more holes. The handle may also be an integrally formed strap or even a handle/strap assembly secured in said top panel.

Preferably the top panel is adhesively secured to all the top sections of the first means and the side panels are adhesively secured to each other. It is possible, however, that one or both of these attachments could be by interlocking formations on the two parts.

According to a second aspect there is provided A pair of blanks for holding a plurality of cans, the first blank having a number of pairs of spaced, oppositely disposed arcuate cuts for receiving a corresponding number of cans so as, in use, to hold the cans in an array such that each can is in substantially touching relation with all immediately adjacent cans and the second blank provides a top panel and one or more side panel means hingedly connected thereto for extending all around the periphery of the plurality of cans, one or more of which side panel means comprises one or more extension portions which, in use, extend around one or more of said cans in contact therewith for attachment to one of said side panels.

Preferably the pairs of cuts are arranged in a rectangular array so as in use to secure a rectangular array of cans. A preferred feature is that the two ends of each cut are located on a straight hinge line and the ends of more than one cut may be on any one hinge line. Between pairs of cuts is a reverse hinge line parallel to said straight hinge line for enabling in use the cans to be disposed in touching relation to each other.

Preferably the top panel is generally rectangular and there are four corresponding side panels, each side panel of one opposite pair of side panels having lateral extensions at both sides. The other pair of side panels may incorporate a sub-panel hingedly connected to the remainder along a parallel hinge line.

Figure 2:
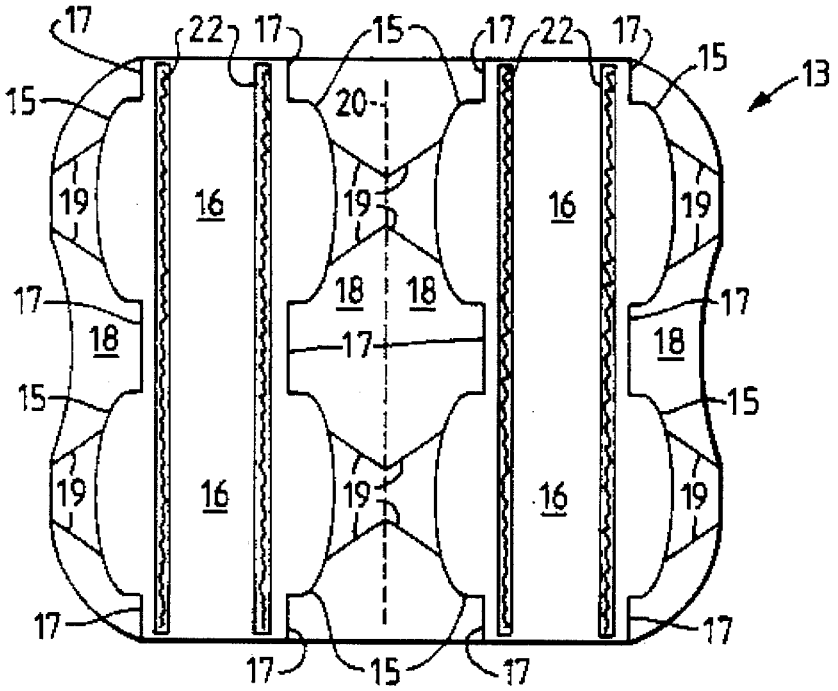
Figure 3:
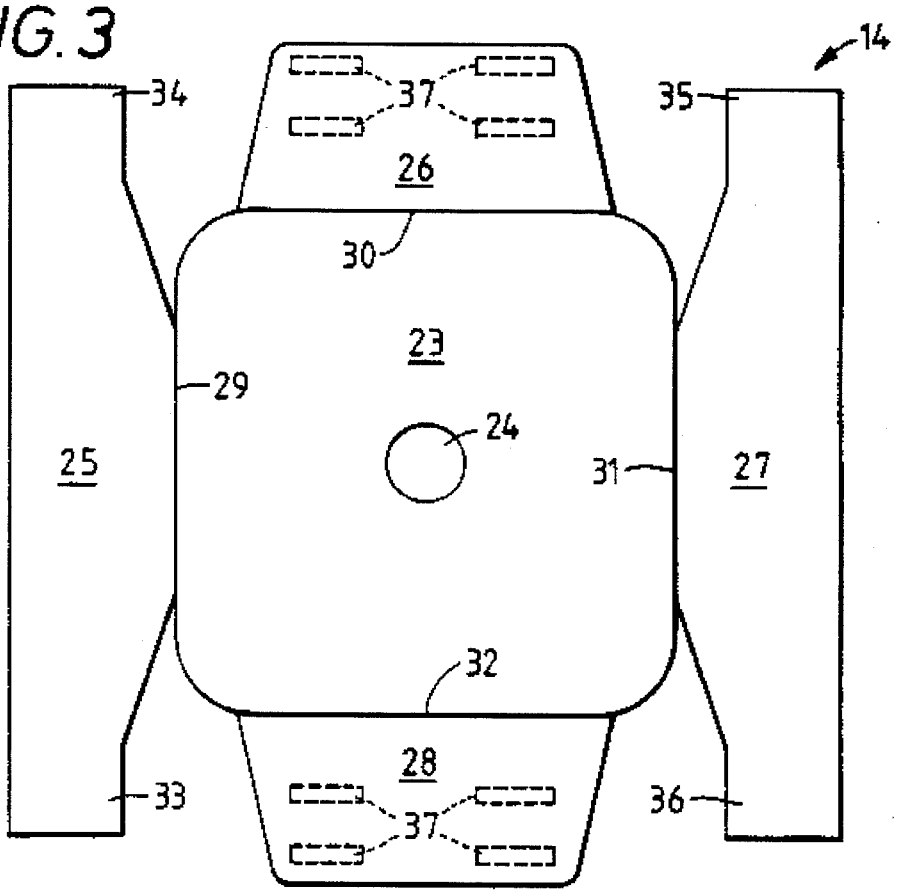
Figure 4:
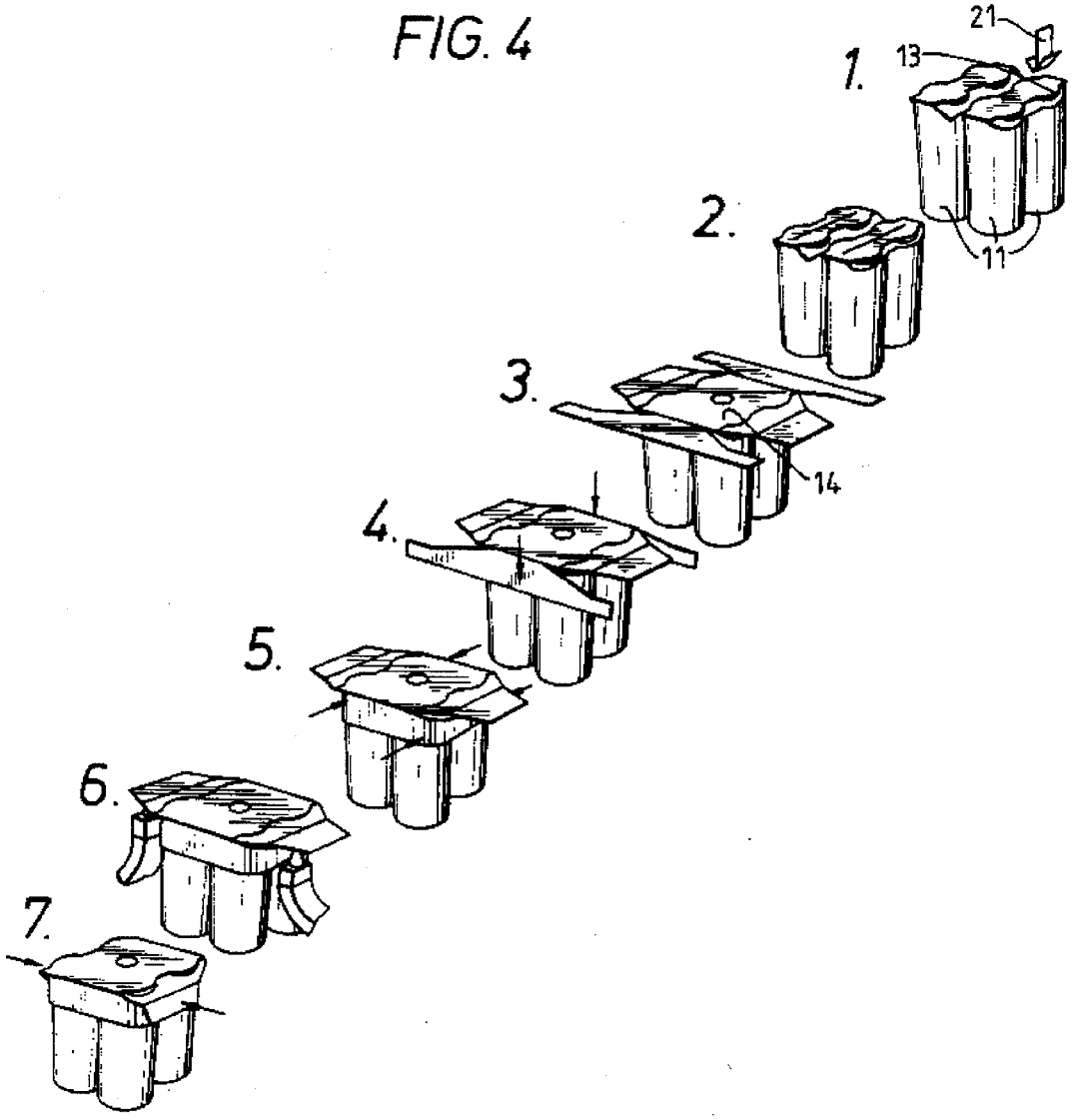
Figure 5:
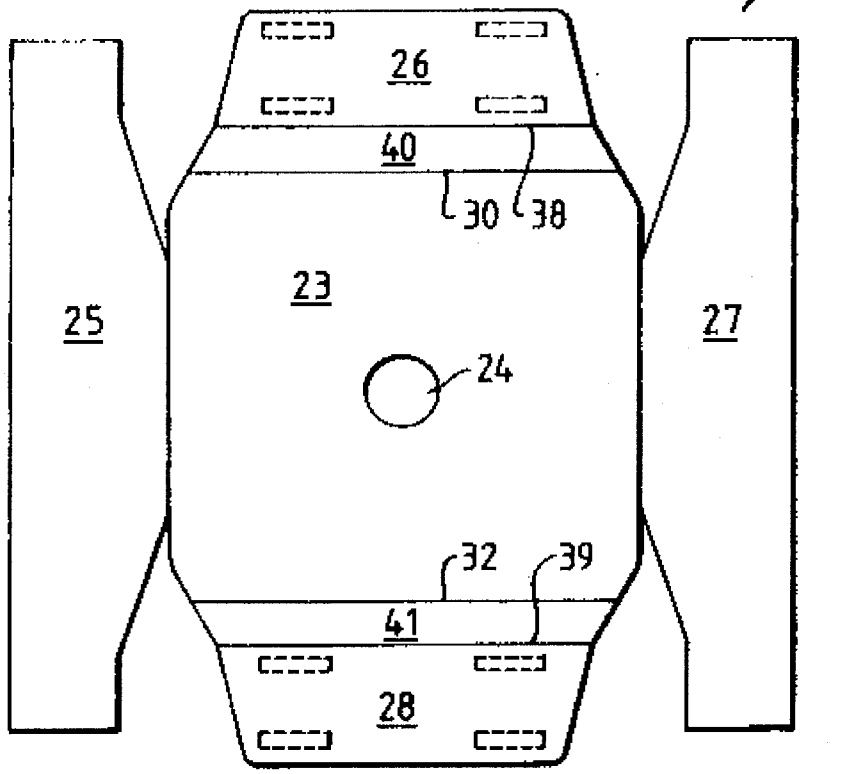

Embodiments of the invention will now be described in more detail. The description makes reference to the accompanying diagrammatic drawings in which:

FIG. 1 shows a perspective view of a complete package according to the present invention, FIG. 2 shows a plan view of a first blank used in the production of the package of FIG. 1, FIG. 3 shows a plan view of a second blank used in the production of the package of FIG. 1, FIG. 4 shows the stage by stage manufacture of the FIG. 1 package, FIG. 5 shows an alternative second blank for use in a package similar to that shown in FIG. 1.

Figure 7:
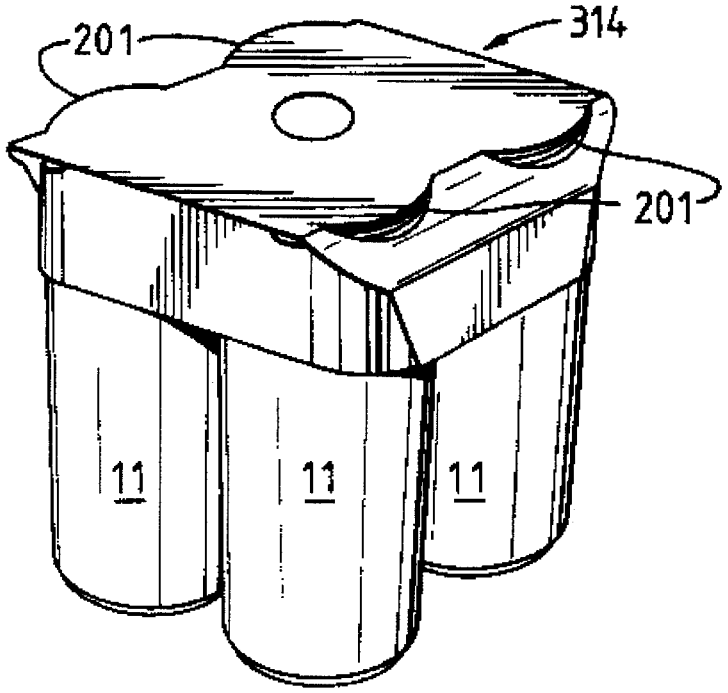
Figure 6:
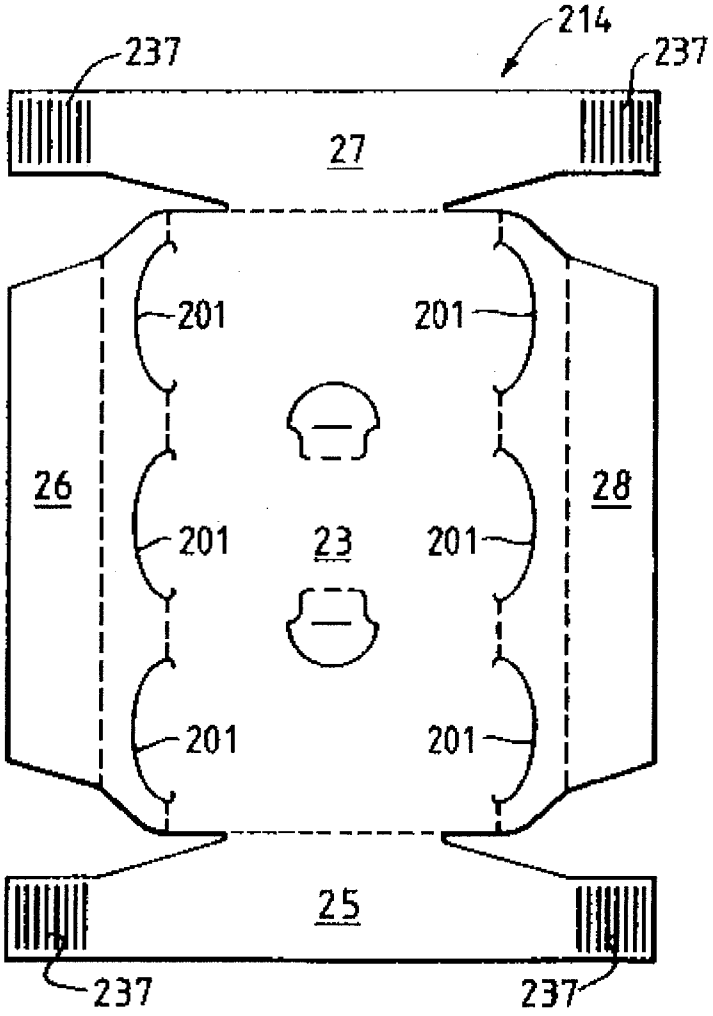

FIG. 6 shows a further alternative second blank for use in a package according to the present invention, and FIG. 7 shows a perspective view of a complete package made using a further blank.

FIGS. 1 to 5 show packages and blanks relating to the manufacture of a 2×2 can multipack. It will be readily appreciated by the skilled reader that the blanks and techniques could be readily adapted to all forms of can multipacks be they simple, such as 2×1, 2×2, 2×3, 2×4, 2×5, 2×6, 3×3, 3×4 or more complex such as hexagonal arrangements of cans, 4-3-4 arrays or similar. Indeed FIGS. 6 and 7 relate to a 2×3 and 2×2 arrays respectively.

FIG. 1 shows a multipack 10 for four cans 11 in a 2×2 array. The cans are tightly packed in the square formation and the sides of the cans 11 are in substantially touching relation to adjacent cans 11. The packaging 12 ms made of paperboard and is formed from two blanks 13, 14. The inner blank 13 is only just visible unlike the outer blank 14. As a result the outer blank provides considerable space for product information, printed advertisements, logos, promotions, information or competitions and the like.

The inner blank 13 is shown in detail in FIG. 2. The blank 13 is generally square with rounded corners. The blank is formed with a number of arcuate cuts 15 which are arranged in pairs. Each pair of cuts 15 defines a top section 16 between them, which top section 16, in use, is located on the tom of the rim of its associated can. Hinge lines 17 extend between the ends of adjacent cuts 15 to form gripping panels 18 and these hinge lines may be creased and/or perforated. To fix the blank 13 on to the set of four cans 11, the cans are disposed below the respective top sections 16 and the gripping panels 18 are pressed down so that the Gripping panels 18 adjacent the arcuate cuts 15 engage below the rims of the cans 11. Further hinge lines 19 depend from the cuts 15 to improve the grim of the panels 18 by modifying the bending of the gripping panels 18 so as to conform more closely to the shape of the cans.

A reverse hinge line 20 is formed midway between the adjacent rows and in manufacture plough can depress the blank 13 along this hinge line 20 and the two rows of cans will be brought closely together, ideally in touching relationship.

The attachment of the inner blank to the cans is shown in stage one of FIG. 4. The plough 21 is visible as it activates the hinge line 20.

Stage 2 of manufacture applies glue to the top faces of all the top sections 16 of the blank 13. The ideal positions of the glue line 22 are shown in FIG. 2. A line 22 is provided adjacent each hinge line 17 to give optimum strength to the resulting package.

FIG. 3 shows the outer blank 14. The blank 14 has a top panel 23 incorporating a hole 24 to facilitate lifting of the assembled multipack 10. The top panel 23 is generally square with rounded corners and has side panels 25, 26, 27, 28 hingedly connected thereto along fold lines 29, 30, 31, 32. Opposite side panels 25, 27 have lateral extensions 33, 34, 35, 36 depending therefrom.

In use the blank is placed centrally on and pressed on to the inner blank 13/cans 11 combination and is stuck thereto by the adhesive lines 22. This is shown in stage 3 of FIG. 4. The side panels 25, 27 having extensions are folded down along fold lines 29, 31 respectively as shown in stage 4 of FIG. 4. The extensions 33, 34, 35, 36 are then folded around the adjacent cans as shown in stage 5 of FIG. 4. Adhesive is then applied to the undersides of side panels 26, 28 as shown in stage 6 of FIG. 4 and they are then bent down along hinge lines 30, 32 respectively as shown in stage 7 of FIG. 4. The side panels 26, 28 are pressed inwards and thus become adhesively secured to extensions 33, 34, 35, 36 of the other side panels 25, 27. FIG. 3 shows in dotted lines the best areas 37 for adhesive to be applied to panels 26, 28.

The result is a strong, simple multipack arrangement 10 formed from paperboard. The multipack retains its rigidity regardless of the manner it is picked up, a feature not present in multipacks using existing plastic rings. This rigidity is advantageous both for consumers and retailers and there is a strong resistance to cans becoming dislodged from the multipack.

The alternative blank 114 shown in FIG. 5 is almost identical to that shown in FIG. 3 and like parts have been given like reference numerals. The only difference is that the side panels 26, 28 incorporate further fold lines 38, 39 parallel to fold lines 30, 32 so as to provide small angled panels 40, 41. Such a blank 114 conforms more closely to modern day beverage cans which have an inwardly bevelled side wall area just below the top rim.

Referring to FIG. 6 there is shown a further blank 214 which is for use in a 2×3 array of cans. The blank 214 is really just an extended version of blanks 14 and 114 for use with a similarly extended inner blank 13. The only significant difference is the provision of slits 201 for receiving the rims of the cans. The slits 201 provide an aesthetic alternative to the straight folded perpendicular side panels 26, 28 of the previously described arrangements.

In FIG. 7 there is shown a package made from a blank 314 which is a 2×2 version of the blank 214 shown in FIG. 6. The blank 314 also provides slits 201 for locating the can rims.

It is also possible to bring together two or more inner blanks, connected to cans, and attach using adhesive a suitably shaped upper blank covering all the inner blanks. This arrangement is not shown, but is simple to understand. For example, 2×(2×3) or 2×or 4×(2×2) arrays can be formed using shaped upper blanks extending over the whole arrays.

It will of course be appreciated that the side panels may extend any distance down the side of the cans 11 depending on the particular requirements of the manufacturer. For example, if a promotion is being run then one side panel may extend a long way down the cans compared to the other side panels.

Also the precise positioning of the extensions is a matter of design choice. For example, they could be longer and extend further around the pack or they may be repositioned so that each side panel has an extension. Also some side panels may be eliminated in certain arrangements. For example, in its most basic form one side panel having one long extension is possible, the extension extending around the entire pack and being adhesively secured to itself. Whilst this arrangement may not provide ideal strength it is very simple and strength/rigidity may not always be a necessity of the manufacturer.

As previously stated the precise gluing positions are a matter of choice as are the precise shapes of the panels.

As an alternative the panels to be adhesively secured together could instead be connected by suitable interlocking means. Many suitable interlocking formations are known in the industry for securing two pieces of paperboard together.

The grain of the paperboard can also be a factor in the strength of the package. For best results the grain of the paperboard extends in the direction perpendicular to the fold line fold 20 on the first blank 13 and perpendicular to the fold lines 30, 32 on the second blank 14. The grain direction is not however essential to the basic operation of the package.

It will be appreciated that the precise adhesive positions described are only examples of suitable positions and may therefore be varied.

We claim:

1. A pair of blanks for holding a plurality of cans, the first blank having a number of pairs of spaced, oppositely disposed arcuate cuts for receiving a corresponding number of cans so as, in use, to hold the cans in an array such that each can is in a substantially touching relation with all immediately adjacent cans and the second blank provides a top panel for attachment to said first blank and one or more side panel means hingedly connected thereto for extending all around only the side periphery of the plurality of cans, at least one of said side panel means comprising at least one extension portion which, in use, extends all around the side of at least one of said cans in contact therewith and attaches to another of said side panel means;

wherein the top panel is generally rectangular and there are four corresponding side panels, each side panel of one opposite pair of side panels having lateral extensions at both sides;

wherein the other pair of side panels each incorporates a sub-panel formed by a hinge line parallel to a second hinge line formed between the side panel and the top panel; and wherein arcuate cuts are provided in the sub-panels for receiving rims of said cans.

2. A pair of blanks as claimed in claim 1 wherein pairs of cuts are arranged in a rectangular array so as to secure a rectangular array of cans.

3. A pair of blanks as claimed in claim 2 wherein two ends of each cut are located on a straight hinge line.

4. A pair of blanks as claimed in claim 3 wherein between pairs of cuts is a reverse hinge line parallel to said straight hinge lines.

5. A package for a plurality of cans, said package comprising:

a first member which for each can has a top section and means integral with said top section for gripping each can below a top rim of said can, said gripping means being arranged in an array such that each can is in a substantially touching relation with all immediately adjacent cans; and a second member having a top panel for attachment to said first member and side panel means for extending all around the periphery of the plurality of cans, said side panel means comprising at least two side panels hinged downwardly relative to said top panel, at least one of said side panels in contact with the cans and having at least one portion extending around at least one can and attaching to at least one adjacent side panel;

the first member being made from a single piece of paperboard which constitutes all said top sections and gripping means;

each gripping means comprising a pair of spaced arcuate cuts between which the top of a can is disposed, the paperboard adjacent the cuts being pressed down under the rim of the can so as to grip the can below the rim;

said array being rectangular;

wherein the top panel is generally rectangular and four side panels are hingedly connected to the top panel.

6. A package as claimed in claim 5 wherein each of a pair of oppositely disposed side panels has a pair of oppositely extending extensions which are, in use, bent around an adjacent corner can of the rectangular array such that each side panel of the other pair of side panels is attached to two extensions, one from each of the first pair of side panels.

7. A pair of blanks for holding a plurality of cans, the first blank having a number of pairs of spaced, oppositely disposed arcuate cuts for receiving a corresponding number of cans so as, in use, to hold the cans in an array such that each can is in a substantially touching relation with all immediately adjacent cans and the second blank provides a top panel and one or more side panel means hingedly connected thereto for extending all around the periphery of the plurality of cans, at least one of said side panel means comprising at least one extension portion which, in use, extends all around at least one of said cans in contact therewith and attaches to another of said side panel means;

the top panel being generally rectangular and there are four corresponding side panels, each side panel of one opposite pair of side panels having lateral extensions at both sides and the other pair of side panels each incorporates a sub-panel formed by a hinge line parallel to a second hinge line formed between the side panel and the top panel;

wherein arcuate cuts are provided in the sub-panels for receiving rims of said cans.

* * * * *